US008932083B2

(12) United States Patent
Ho

(10) Patent No.: US 8,932,083 B2
(45) Date of Patent: Jan. 13, 2015

(54) CONNECTOR AND CONNECTOR ASSEMBLY FOR USE WITH FLEX CIRCUITS

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 190 days.

(21) Appl. No.: 13/525,529

(22) Filed: Jun. 18, 2012

(65) Prior Publication Data

US 2012/0329334 A1 Dec. 27, 2012

(30) Foreign Application Priority Data

Jun. 17, 2011 (TW) ..... 100121219 A

(51) Int. Cl.

| | |
|---|---|
| ***H01R 24/76*** | (2011.01) |
| ***H01R 12/79*** | (2011.01) |
| ***H01R 12/61*** | (2011.01) |
| *H01R 13/24* | (2006.01) |

(52) U.S. Cl.

CPC ..... *H01R 12/613* (2013.01); *H01R 12/79* (2013.01); *H01R 13/2442* (2013.01)

USPC ..... 439/660

(58) Field of Classification Search

CPC ..... H01R 23/7073; H01R 2/70633

USPC ..... 439/570, 660, 638, 929; 361/679.4, 361/679.45

See application file for complete search history.

(56) References Cited

U.S. PATENT DOCUMENTS

| | | | | | |
|---|---|---|---|---|---|
| 3,017,469 | A | * | 1/1962 | Giller | 200/52 R |
| 3,644,873 | A | * | 2/1972 | Dalton et al. | 439/299 |
| 4,352,492 | A | * | 10/1982 | Smith | 463/44 |
| 4,418,975 | A | * | 12/1983 | O'Keefe, II | 439/344 |
| 4,431,245 | A | * | 2/1984 | Jigamian et al. | 439/344 |
| 4,948,379 | A | * | 8/1990 | Evans | 439/329 |
| 5,035,649 | A | * | 7/1991 | Collier et al. | 439/607.41 |
| 5,057,035 | A | * | 10/1991 | Drewnicki | 439/425 |
| 5,118,312 | A | * | 6/1992 | Lu | 439/676 |
| 5,158,468 | A | * | 10/1992 | Curtis et al. | 439/76.1 |
| 5,425,646 | A | * | 6/1995 | Green | 439/79 |
| 5,431,570 | A | * | 7/1995 | Gibbs et al. | 439/39 |
| 5,744,934 | A | * | 4/1998 | Wu | 320/111 |
| 5,888,087 | A | * | 3/1999 | Hanson et al. | 439/374 |
| 6,027,381 | A | | 2/2000 | Lok | |
| 6,159,038 | A | * | 12/2000 | Wu | 439/495 |

(Continued)

FOREIGN PATENT DOCUMENTS

| | | | |
|---|---|---|---|
| TW | 493301 | B | 1/2002 |
| TW | M302808 | U | 12/2006 |
| TW | M364298 | U | 9/2009 |

*Primary Examiner* — Neil Abrams

(74) *Attorney, Agent, or Firm* — Stephen L. Sheldon

(57) ABSTRACT

An assembly comprises a plug device and a receptacle device which can be mated with each other. The plug device comprises an outer housing, a first circuit board, and a plug connector. The outer housing comprises an upper housing and a lower housing having a penetrating window. The plug connector comprises an insulative body and a first terminal group. The receptacle device comprises a casing and a receptacle connector. The casing has an insertion groove communicated with an outside and is engaged with the plug device and a receiving groove located under the insertion groove and communicated with the insertion groove. The receptacle connector comprises an insulative base and a second terminal group. Electrical connections are established between the contact portions of the second terminals and contact portions of corresponding first terminals of the first terminal group when the plug device is positioned in the insertion groove.

8 Claims, 6 Drawing Sheets

(56) References Cited

U.S. PATENT DOCUMENTS

| | | | | |
|---|---|---|---|---|
| 6,315,620 | B1 * | 11/2001 | Moir et al. | 439/862 |
| 6,579,122 | B1 * | 6/2003 | Chen | 439/570 |
| 6,846,115 | B1 * | 1/2005 | Shang et al. | 385/92 |
| 6,854,995 | B2 * | 2/2005 | Hotea | 439/260 |
| 6,855,013 | B2 | 2/2005 | Chiang et al. | |
| 6,939,155 | B2 * | 9/2005 | Postrel | 439/297 |
| 7,008,246 | B2 * | 3/2006 | Zhuge | 439/173 |
| 7,114,965 | B2 * | 10/2006 | Jin | 439/83 |
| 7,175,443 | B2 * | 2/2007 | Mizuno et al. | 439/76.1 |
| 7,271,760 | B2 * | 9/2007 | Bartosik et al. | 342/20 |
| 7,438,561 | B2 * | 10/2008 | Chen | 439/79 |
| 7,677,904 | B1 * | 3/2010 | Gao et al. | 439/79 |
| 7,766,668 | B1 * | 8/2010 | Bishop | 439/66 |
| 8,079,864 | B2 * | 12/2011 | Lin et al. | 439/344 |
| 8,157,598 | B2 * | 4/2012 | Niitsu | 439/660 |
| 8,292,648 | B2 * | 10/2012 | Kiryu et al. | 439/328 |
| 8,337,222 | B2 * | 12/2012 | Hung et al. | 439/138 |
| 8,512,051 | B2 * | 8/2013 | Chiu et al. | 439/76.1 |
| 8,715,019 | B2 * | 5/2014 | Ho | 439/862 |
| 2003/0220009 | A1 * | 11/2003 | Takeguchi et al. | 439/374 |
| 2013/0244501 | A1 * | 9/2013 | Hsu et al. | 439/701 |

* cited by examiner

CONNECTOR AND CONNECTOR ASSEMBLY FOR USE WITH FLEX CIRCUITS

RELATED APPLICATIONS

This application claims priority to Taiwanese Application No. 100121219, filed Jun. 17, 2011, which is incorporated herein by reference in its entirety.

TECHNICAL FIELD

The present application relates to an electrical connection device, and more specifically, to a plug device, a receptacle device, and an assembly thereof.

BACKGROUND ART

Currently, a navigation device for use in automobile is directly built-in an instrument panel, or is bought by a user additionally. For a navigation device additionally bought by a user, it is generally required to fix the navigation device with a mounting bracket. It is common to fix the mounting bracket on a windshield by a suction cup, and to electrically connect the navigation device to a circuit system of the automobile by a connection cable so as to provide power supply for the navigation device.

It is inconvenient to install and receive the mounting bracket, and the long connection cable will not only interfere with people's vision, but also it is easy to make activity be restricted. Therefore, it is required to make an improvement.

SUMMARY OF THE INVENTION

In an embodiment, an assembly of a plug device and a receptacle device comprises a plug device and a receptacle device which can be mated with each other. The plug device comprises an outer housing, a first circuit board, and a plug connector. The outer housing comprises an upper housing and a lower housing, the upper housing and the lower housing are mated and define a receiving space, and the lower housing has a penetrating window. At least a part of the first circuit board is provided in the receiving space. The plug connector is provided on the first circuit board and is located in the receiving space, and the plug connector comprises an insulative body and a first terminal group provided to the insulative body. The insulative body has a mounting face connecting the first circuit board, a mating face located at an opposite side of the mounting face, and a stopping portion located between the mating face and the mounting face and protruding sidewardly; a part of the insulative body comprising the mating face extends through the window and extends out of the outer housing, and the stopping portion abuts against an inner side of the lower housing adjacent to the window. The first terminal group consists of a plurality of first terminals spaced apart from each other, each of the first terminals has a soldering portion extending out of the insulative body and soldered on the first circuit board and a contact portion located on the mating face. The receptacle device comprises a casing and a receptacle connector. The casing has an insertion groove communicated with an outside and engaged with the plug device and a receiving groove located under the insertion groove and communicated with the insertion groove. The receptacle connector is provided in the casing, and comprises an insulative base and a second terminal group provided to the insulative base. The insulative base is located in the receiving groove. The second terminal group consists of a plurality of second terminals spaced apart from each other and corresponds to the first terminal group. Each of the second terminals has a resilient arm extending out of the insulative base and a contact portion connecting a distal end of the resilient arm and extending into the insertion groove, the contact portions of the second terminals are electrically connected to the corresponding contact portion of the first terminals when the plug device is positioned in the insertion groove.

Preferably, the casing further has a pair of guide rails spaced apart from each other and located at two sides of the insertion groove and above the receiving groove, a spacing distance between the pair of spaced guide rails can have the part of the insulative body of the plug device extending out of the window pass through, and the outer housing of the plug device is supported and held by the pair of guide rails. In addition, the receptacle device cane further include a second circuit board fixedly provided inside the casing and located in the receiving groove, and the receptacle connector is fixedly provided on the second circuit board and electrically connected to the second circuit board.

Preferably, the receptacle device further comprises two fixing members; the two fixing members are integrally respectively connected to the two terminals of the second terminal group respectively arranged at two outermost sides of the second terminals and extend out of two opposite side faces of the insulative base in a direction away from each other; the two fixing members and the second terminal group are integrally engaged with and fixed by the insulative base by means of insert molding while the insulative base is formed.

Preferably, the upper housing and the lower housing of the outer housing further together define an opening via which the receiving space is communicated with an outside, and the window of the lower housing is spaced apart from a side of the opening. The first circuit board is a flexible circuit board, a part of the first circuit board is located in the receiving space and the other part of the first circuit board extends out of the outer housing via the opening. The second circuit board also is a flexible circuit board.

DETAILED DESCRIPTION OF THE PREFERRED EMBODIMENTS

Figure 1:
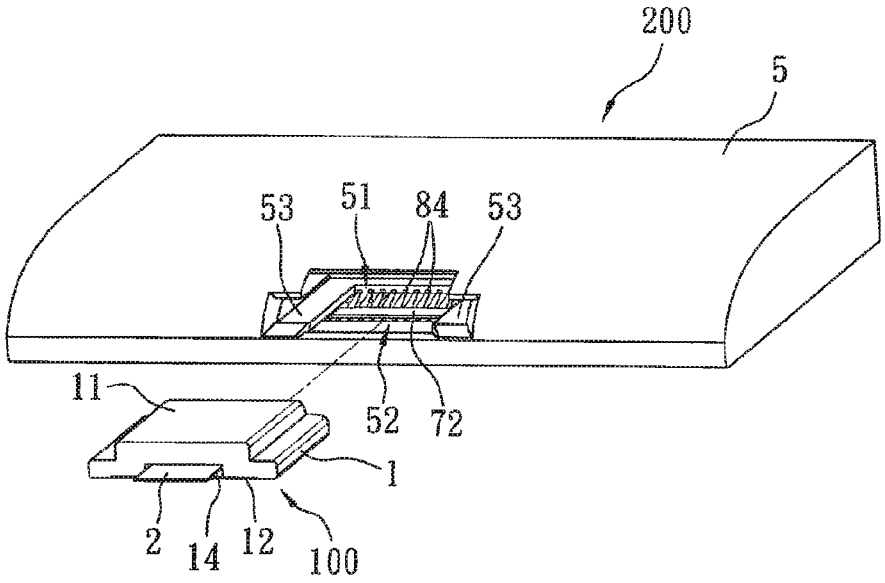
FIG. 1 is a perspective view illustrating an assembly of a plug device and a receptacle device of a preferred embodiment of the present application.

The foregoing and other technical contents, features and effects of the present application will be apparent from the following detailed description for a preferred embodiment in combination with the drawings. It should be noted that like reference numerals identify like elements in the following description.

As can be appreciated, benefits of the application can include the following. The plug device can serve as the supporting body, and the receptacle device can be provided in an electronic device. By engaging the plug device with the receptacle device, the electronic device is supported and an electrical connection is established at the same time, an additional mounting bracket and an additional connection cable can be omitted, it is convenient to use and there is not a disturbance from a messy connection cable. Furthermore, that the mating face of the plug connector extends out of the outer housing can increase stability of an electrical connection between the plug connector of the plug device and the receptacle connector of the receptacle device.

Referring to FIGS. 1-4, an assembly of a plug device and a receptacle device of a preferred embodiment of the present application comprises a plug device 100 and a receptacle device 200 which can be mated with each other. The plug device 100 is applicable to be provided, for example, to an instrument panel of an automobile; the receptacle device 200 is applicable to be provided to an electronic device, for example, a navigation device.

The plug device 100 comprises: an outer housing 1, a first circuit board 2, and a plug connector 10. The outer housing 1 comprises an upper housing 11 and a lower housing 12, the upper housing 11 and the lower housing 12 are mated with each other and together define a receiving space 13 and an opening 14 via which the receiving space 13 is communicated with an outside, and the lower housing 12 has a penetrating window 121 spaced apart from a side of the opening 14.

The first circuit board 2 is fixedly provided at an inner side of the upper housing 11. In the present preferred embodiment, the first circuit board 2 is a flexible circuit board, has a T-shaped outline, and is supported by a supporting plate 21 at a transversal area of the T-shaped outline. A part of the first circuit board 2 is located in the receiving space 13 and the other part of the first circuit board 2 extends out of the outer housing 1 via the opening 14, the part extending out of the outer housing 1, i.e. a tail end of a longitudinal area of the T-shaped outline, may be used to electrically connect an exterior circuit.

The plug connector 10 is provided on the first circuit board 2 and located in the receiving space 13, and comprises an insulative body 3 and a first terminal group 40 provided to the insulative body 3. The insulative body 3 has: a mounting face 31 connecting the first circuit board 2; a mating face 32 located at an opposite side of the mounting face 31; and a stopping portion 33 located between the mating face 32 and the mounting face 31 and protruding sidewardly. A part of the insulative body 3 comprising the mating face 32 passes through the window 121 and extends out of the outer housing 1, and the stopping portion 33 abuts against an inner side of the lower housing 12 adjacent to the window 121, that is, a shape and size of the window 121 is matched with an outline of the part of the insulative body 3 from a periphery of the mating face 32 to a front surface of the stopping portion 33, so that the part can pass through the window 121 and extends out of the outer housing 1, and by that the stopping portion 33 abuts against the lower housing 12, the insulative body 3 can be prevented from entirely disengaging the outer housing 1, so that it can be held by the outer housing 1.

The first terminal group 40 consists of a plurality of first terminals 4 spaced apart from each other; each of the first terminals 4 has a fixed portion 41, a soldering portion 42, and a contact portion 43. The fixed portion 41 is fixedly provided to the insulative body 3; the soldering portion 42 extends out of the insulative body 3 from one end of the fixed portion 41 and is soldered on the first circuit board 2; the contact portion 43 extends from the other end of the fixed portion 41 and is located at the mating face 32.

Moreover, the plug connector 10 further comprises two fixing members 30 provided respectively at two sides of the insulative body 3. The fixing members 30 and the first terminal group 40 are integrally engaged with and fixed by the insulative body 3 by means of insert molding while the insulative body 3 is formed. The two fixing members 30 are soldered on the first circuit board 2, thereby enhancing engagement strength of the insulative body 3 and the first circuit board 2.

Figure 6:
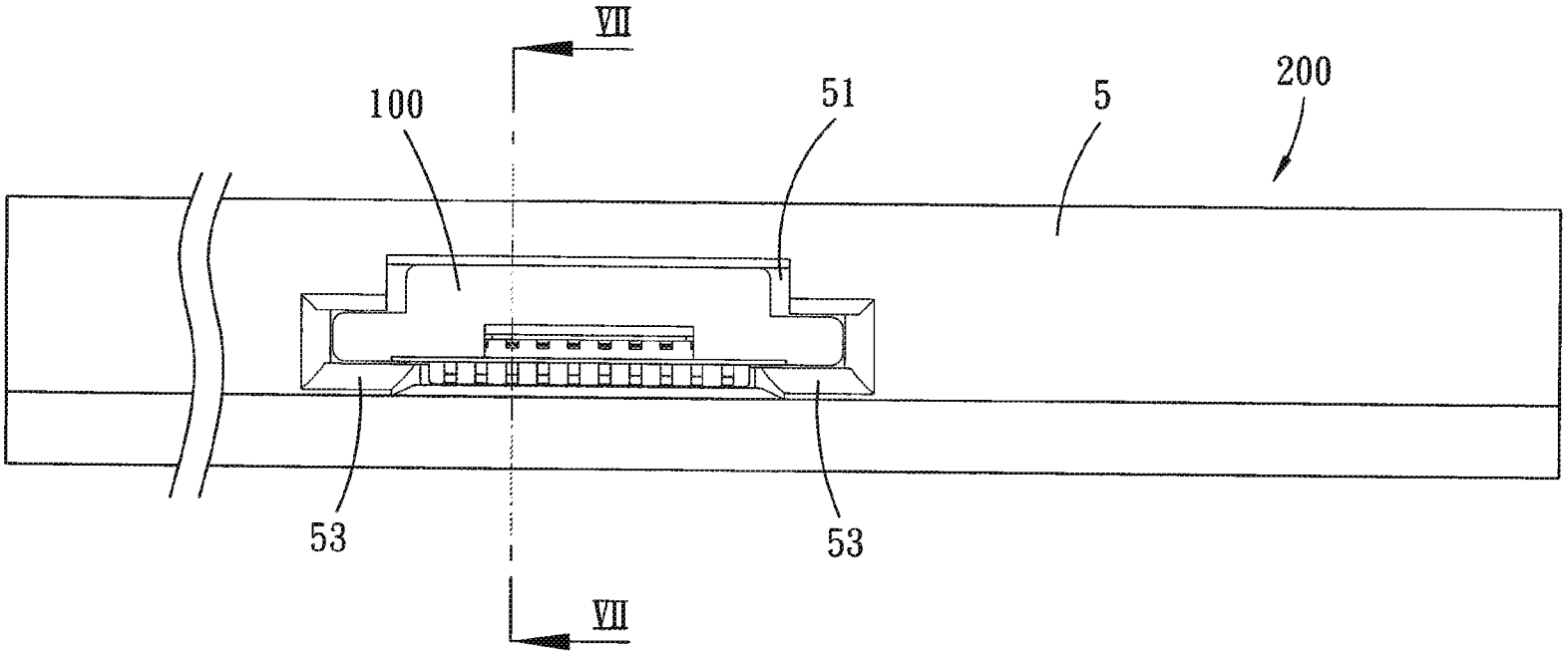
FIG. 6 is a front view of FIG. 5.
Figure 7:
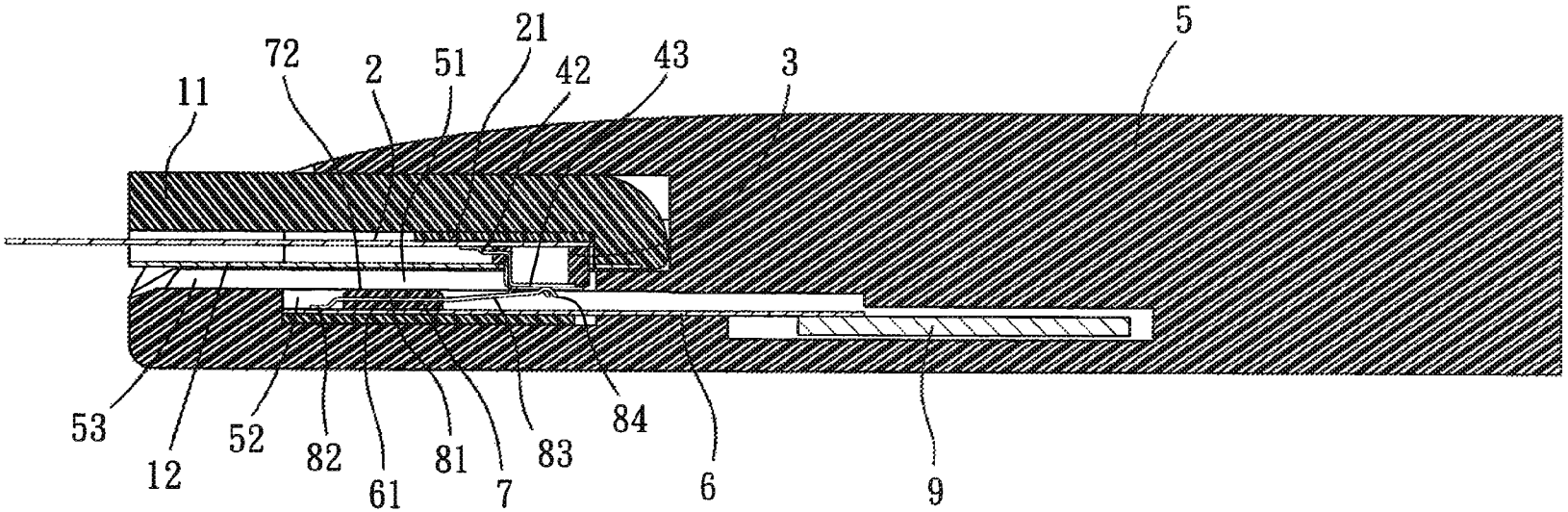
FIG. 7 is a cross sectional view along a VII-VII straight line of FIG. 6.

The receptacle device 200 comprises a casing 5, a second circuit board 6, and a receptacle connector 20. Referring to FIG. 1, FIG. 6 and FIG. 7, the casing 5 has an insertion groove 51 communicated with an outside and engaged with the plug device 100 and a receiving groove 52 located under the insertion groove 51 and communicated with the insertion groove 51.

Referring to FIGS. 2-4 again by combination with FIG. 7, the second circuit board 6 is fixedly provided inside the casing 5 and located in the receiving groove 52. In the present preferred embodiment, the second circuit board 6 also is a flexible circuit board and is supported by a supporting plate 61, and a tail end of the second circuit board 6 is electrically connected to a mainboard 9 of an electronic device.

The receptacle connector 20 is provided in the casing 5 and fixedly provided on the second circuit board 6. The receptacle connector 20 comprises an insulative base 7, a second terminal group 80 provided to the insulative base 7, and two fixing members 70. The insulative base 7 is located in the receiving groove 52; specifically, the insulative base 7 has a bottom surface 71 connecting the second circuit board 6 and a top surface 72 located at an opposite side of the bottom surface 71. That the insulative base 7 is located in the receiving groove 52 means that the top surface 72 of the insulative base 7 is no higher than the receiving groove 52 and thus lower than the insertion groove 51, that is, the top surface 72 of the insulative base 7 will not enter into the insertion groove 51. The second terminal group 80 consists of a plurality of second terminals 8 spaced apart from each other and corresponds to the first terminal group 4. Each of the second terminals 8 has a fixed portion 81, a soldering portion 82, a resilient arm 83, and a contact portion 84.

As depicted, the fixed portion 81 is fixedly provided to the insulative base 7; the soldering portion 82 extends out of the insulative base 7 from one end of the fixed portion 81 and is soldered on the second circuit board 6; the resilient arm 83 extends out of the insulative base 7 from the other end of the fixed portion 81; the contact portion 84 is connected to a distal end of the resilient arm 83 and extends into the insertion groove 51. The fixing members 70 are integrally respectively connected to the fixed portions 81 of the two second terminals 8 respectively arranged at two outermost sides of the second terminal group 80, and extend out of two opposite side faces 73 of the insulative base 7 from the corresponding fixed portion 81 in a direction away from each other. The fixing members 70 and each of the second terminals 8 are integrally engaged with and fixed by the insulative base 7 by means of the insert molding while the insulative base 7 is formed. Each of the fixing members 70 and the second terminal 8 connecting to the each of the fixing members 70 are integrally formed, this can not only simplify a process independently manufacturing the fixing members 70, but also it is easy to be positioned when the fixing members 70 are engaged with the insulative base 7. The two fixing members 70 are soldered on the second circuit board 6, thereby enhancing engagement strength of the insulative base 7 and the second circuit board 6. In the present embodiment, the second circuit board 6 employs a flexible circuit board. However, in other embodiments, the second circuit board 6 can also be a part of a mainboard 9 of an electronic device; or the second terminals 8 are electrically connected to a mainboard 9 of an electronic device by a conductive wire, thereby not providing the second circuit board 6.

Figure 2:
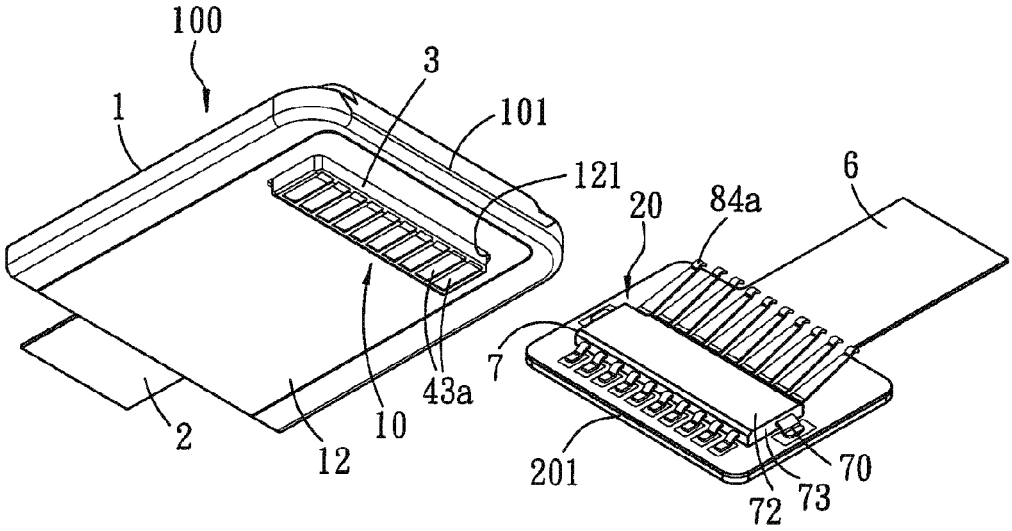
FIG. 2 is a perspective view illustrating an assembly of the plug device and the receptacle device of the preferred embodiment, wherein, a casing of the receptacle device is omitted.
Figure 3:
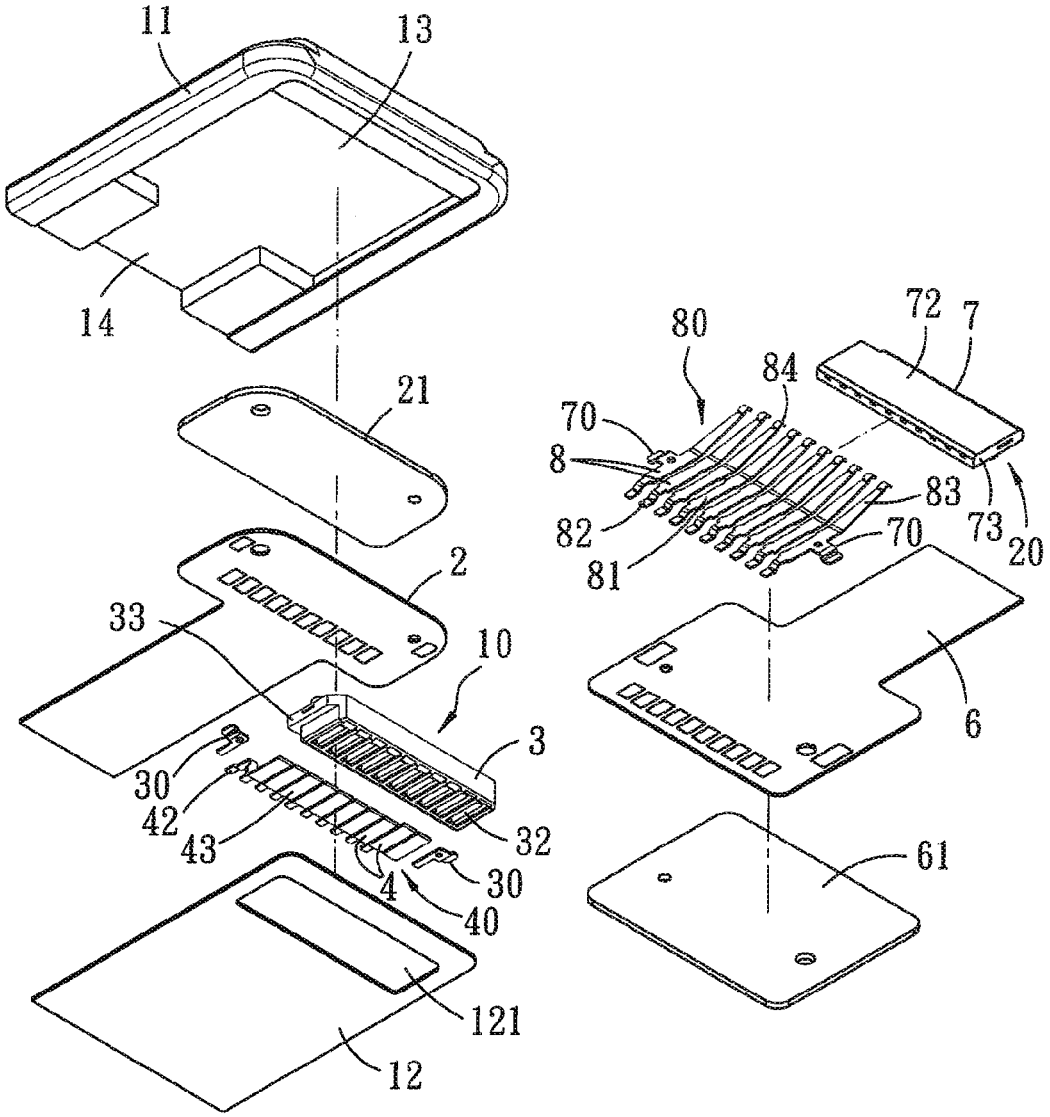
FIG. 3 is an exploded perspective view of FIG. 2.
Figure 4:
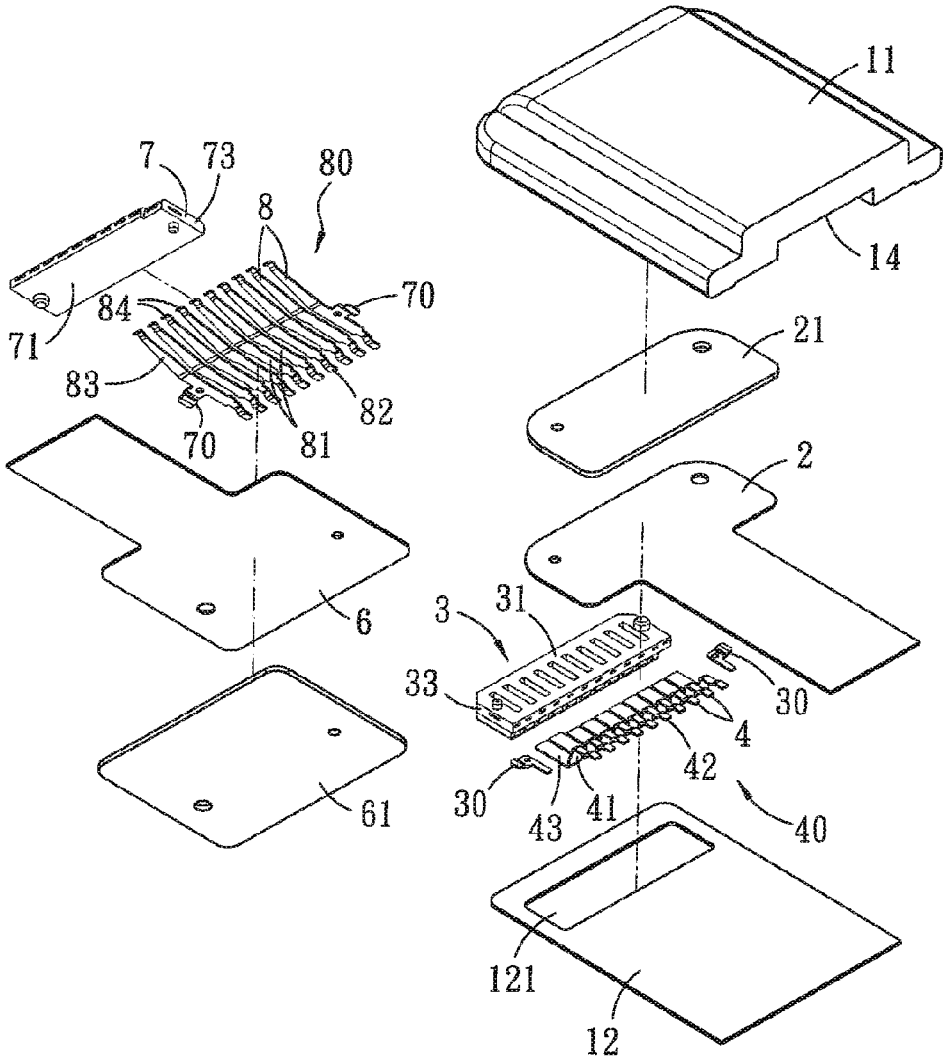
FIG. 4 is a view of FIG. 3 viewed from another view angle.
Figure 5:
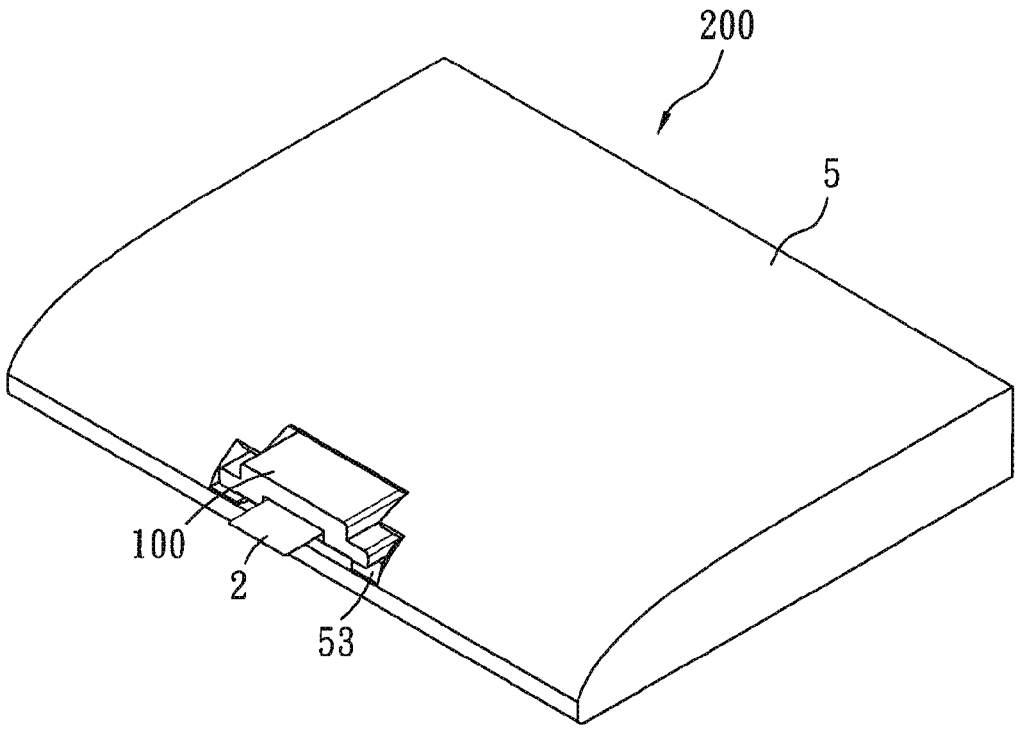
FIG. 5 is a perspective view illustrating that the plug device is mated with the receptacle device in the preferred embodiment.

Referring to FIG. 1, FIG. 2 and FIGS. 5-7 again, the casing 5 further has a pair of guide rails 53 spaced apart from each other and located at two sides of the insertion groove 51 and above the receiving groove 52, and a spacing distance between the pair of guide rails 53 can have the insulative body 3 of the plug device 100 extending out of the window 121 pass through, so that the outer housing 1 of the plug device 100 is supported by the pair of guide rails 53. Because the pair of guide rails 53 are located above the receiving groove 52, and the spacing distance can have the insulative body 3 of the plug device 100 extending out of the window 121 pass through; when the plug device 100 is mated with the receptacle device 200, two sides of a bottom portion (namely, a side where the lower housing 12 is present) of the outer housing 1 are supported by the corresponding guide rails 53 respectively and slide along the pair of guide rails 53 while the plug device 100 is inserted into the insertion groove 51, in this way, it can be ensured that the plug device 100 only moves in the insertion groove 51; and the insulative base 7 of the receptacle connector 20 is located in the receiving groove 52 and the top surface 72 of the insulative base 7 will not extend into the insertion groove 51, so that the part of the insulative body 3 of the plug device 100 extending out of the window 121 will not contact the insulative base 7 of the receptacle connector 20 while the plug device 100 is inserted into the receiving groove 52 until being positioned, therefore the first terminal group 40 is smoothly slide-connected to the second terminal group 80, and the contact portions 84 of the second terminals 8 are electrically connected to the contact portions 43 of the corresponding first terminals 4 when the plug device 100 is positioned in the insertion groove 51.

Furthermore, in a preferred embodiment, the plug device 100 and the receptacle device 200 respectively have mating sides 101, 201 which are firstly in contact with each other. The first terminal group 40 has the two terminals 4 of which the contact portions 43*a* are close to the mating side 101 relative to the contact portions 43 of the other terminals 4 of the first terminal group 40 (namely, two left-most terminals 4 of the first terminal group 40 in a direction as shown in FIG. 2), and the second terminal group 80 has one terminal 8 of which the contact portion 84*a* is close to the mating side 201 relative to the contact portions 84 of the other terminals 8 of the second terminal group 80 (namely, one left-most terminal 8 of the second terminal group 80 in the direction as shown in FIG. 2), so that contacts for the terminals 4 of the first terminal group 40 and the corresponding terminals 8 of the second terminal group 80 are performed at three different times while the plug device 100 is inserted into the receptacle device 200.

In these contacts, firstly, the contact portion 84*a* of the second terminal group 80 contacts the corresponding contact portion 43*a* of the first terminal group 40, because both are closest respectively to the mating sides 101, 201; secondly, the other contact portion 43*a* of the first terminal group 40 contacts the corresponding contact portion 84 of the second terminal group 80, because the other contact portion 43*a* is close to the mating side 101 relative to the contact portions 43, the other contact portion 43*a* is first in contact with the contact portion 84 of the second terminal group 80 relative to the contact portions 43; finally, the contact portions 43 of the first terminal group 40 contact the other corresponding contact portions 84 of the second terminal group 80. Similarly, if the first terminal group 40 has only one terminal 4 of which the contact portion 43*a* is close to the mating side 101 relative to the contact portions 43 of the other terminals 4 of the first terminal group 40, and the second terminal group 80 has two terminals 8 of which the contact portions 84*a* are close to the mating side 201 relative to the contact portions 84 of the other terminals 8 of the second terminal group 80 (one of the two contact portions 84*a* corresponds to the contact portion 43*a*), it can also be achieved that contacts for the terminals 4 of the first terminal group 40 and the corresponding terminals 8 of the second terminal group 80 are performed at three different times. Therefore, the terminals being firstly in contact are configured as grounding terminals; the terminals being in contact at the second time are configured as power terminals; the terminals being in contact at the third time are configured as signal terminals; in this way, it can be ensured that the connected electronic device firstly grounds so that this can prevent the unexpected high current damaging the electronic device from generating, and it can be ensured that signal transmission begins after turning on power supply, so that this can prevent a sent signal from being missed.

Therefore, the outer housing 1 of the plug device 100 of the preferred embodiment is mated with the insertion groove 51 of the receptacle device 200 of the present preferred embodiment and may be received in the insertion groove 51. When the plug device 100 is upwardly fixed, for example, the plug device 100 is upwardly fixedly provided in an instrument panel of an automobile, the plug device 100 can serve as a supporting body for supporting an electrical device (e.g. a navigation device) provided with the receptacle device 200. In this way, a mounting bracket and a connection cable can be omitted. It is convenient to use and there is not a disturbance from a messy connection cable. Furthermore, the mating face 32 of the plug connector 10 extends out of the outer housing 1, and this can increase stability of an electrical connection between the plug connector 10 of the plug device 100 and the receptacle connector 20 of the receptacle device 200.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An assembly, comprising:

a plug device that includes an outer housing comprising an upper housing and a lower housing, the upper housing and the lower housing being mated and defining a receiving space, and the lower housing having a penetrating window, a first circuit board of which at least a part is provided in the receiving space and a plug connector provided on the first circuit board and located in the receiving space, and the plug connector comprising an insulative body and a first terminal group provided to the insulative body; the insulative body having a mounting face connecting the first circuit board, a mating face located at an opposite side of the mounting face, and a stopping portion located between the mating face and the mounting face and protruding sidewardly; a part of the insulative body which comprises the mating face extending through the window and extending out of the outer housing; and the stopping portion abutting against an inner side of the lower housing adjacent to the window; the first terminal group consisting of a plurality of first terminals spaced apart from each other; each of the first terminals having a soldering portion extending out of the insulative body and soldered on the first circuit board and a contact portion located on the mating face; and a receptacle device that includes a casing having an insertion groove communicated with an outside and engaged with the plug device and a receiving groove located under the insertion groove and communicated with the insertion groove, and a receptacle connector provided in the casing and comprising an insulative base and a second terminal group provided to the insulative base, the insulative base located in the receiving groove, the second terminal group consisting of a plurality of second terminals spaced apart from each other and corresponding to the first terminal group, each of the second terminals having a resilient arm extending out of the insulative base and a contact portion connecting a distal end of the resilient arm and extending into the insertion groove, the contact portions of the second terminals being electrically connected to the corresponding contact portion of the first terminals when the plug device is positioned in die insertion groove.

2. The assembly according to claim 1, wherein the casing further has a pair of guide rails spaced apart from each other and located at two sides of the insertion groove and above the receiving groove, a spacing distance between the pair of spaced guide rails can have the part of the insulative body of the plug device extending out of the window pass through, and the outer housing of the plug device is supported and held by the pair of guide rails.

3. The assembly according to claim 2, wherein the receptacle device further comprises a second circuit board fixedly provided inside the casing and located in the receiving groove, and the receptacle connector is fixedly provided on the second circuit board and electrically connected to the second circuit board.

4. The assembly according to claim 1, wherein the upper housing and the lower housing of the outer housing further together define an opening via which the receiving space is communicated with an outside; and the window of the lower housing is spaced apart from a side of the opening; a part of the first circuit board is located in the receiving space, and the other part of the first circuit board extends out of the outer housing via the opening.

5. The assembly according to claim 4, wherein the first circuit board is a flexible circuit board.

6. The assembly according to claim 1, wherein the receptacle device further comprises two fixing members; the two fixing members are integrally respectively connected to the two terminals of the second terminal group respectively arranged at two outermost sides of the second terminals and extend out of two opposite side faces of the insulative base in a direction away from each other; the two fixing members and the second terminal group are integrally engaged with and fixed by the insulative base by means of insert molding while the insulative base is formed.

7. The assembly according to claim 1, wherein the plug device and the receptacle device respectively have mating sides which are firstly in contact with each other; one of the first terminal group and the second terminal group has the two terminals of which the contact portions are close to the mating side thereof relative to the contact portions of the other terminals of the same terminal group, and the other of the first terminal group and the second terminal group has one terminal of which the contact portion is close to the mating side thereof relative to the contact portions of the other terminals of the same terminal group, so that contacts for the terminals of the first terminal group and the corresponding terminals of the second terminal group are performed at three different times while the plug device is inserted into the receptacle device.

8. A receptacle device, comprising:

a receptacle connector comprising an insulative base, a second terminal group provided to the insulative base, and two fixing members; the second terminal group consisting of a plurality of second terminals spaced apart from each other; each of the second terminals having a fixed portion fixedly provided to the insulative base a soldering portion extending out of the insulative base from an end of the fixed portion, a resilient arm extending out of the insulative base from the other end of the fixed portion, and a contact portion connecting a distal end of the resilient arm; the two fixing members being integrally respectively connected to the fixed portions of the two terminals of the second terminal group arranged at two outermost sides of the second terminals respectively and extending out of two opposite side faces of the insulative base from the corresponding fixed portions in a direction away from each other; the two fixing members and the second terminal group integrally engaged with and fixed by the insulative base by means of insert molding, while the insulative base is formed;

a circuit board, the receptacle connector being provided on the circuit board, and the two fixing members and the soldering portions of the second terminals being soldered on the circuit board; and a casing, the casing having an insertion groove communicated with an outside and a receiving groove located under the insertion groove and communicated with the insertion groove, the receptacle connector and the circuit board being provided in the casing, the insulative base and the circuit board being located in the receiving groove, and each of the contact portions of the second terminals extending into the insertion groove.

* * * * *